United States Patent [19]

Marchitto et al.

[11] Patent Number: 5,022,563

[45] Date of Patent: Jun. 11, 1991

[54] DISPENSER-GUN ASSEMBLY FOR VISCOUS FLUIDS AND DISPENSER THEREFOR

[75] Inventors: Michael Marchitto, Cumberland; Steven F. Lord, Rumford, both of R.I.

[73] Assignee: Electron Fusion Devices, Inc., East Providence, R.I.

[21] Appl. No.: 463,278

[22] Filed: Jan. 10, 1990

[51] Int. Cl.[5] ..... B67D 5/42

[52] U.S. Cl. ..... 222/327; 222/391

[58] Field of Search ..... 222/326, 327, 386, 386.5, 222/391, 41, 43

[56] References Cited

U.S. PATENT DOCUMENTS

| | | | |
|---|---|---|---|
| 1,718,596 | 6/1929 | Smith | 222/391 |
| 2,875,761 | 3/1959 | Helmer et al. | 222/43 |
| 2,892,457 | 6/1959 | Sturtz | 222/391 |
| 3,141,583 | 7/1964 | Mapel et al. | 222/391 |
| 3,517,668 | 6/1970 | Brickson | 222/391 |
| 4,159,784 | 7/1979 | d'Autry | 222/43 |
| 4,444,335 | 4/1984 | Wood et al. | 222/43 |
| 4,626,509 | 12/1986 | Lyman | 222/48 |
| 4,678,107 | 7/1987 | Ennis, III | 222/386.5 |

*Primary Examiner*—Michael S. Huppert
*Assistant Examiner*—Pamela Jordan
*Attorney, Agent, or Firm*—Salter & Michaelson

[57] ABSTRACT

A dispenser for viscous fluids includes a tubular cylindrical barrel member, a dispensing nozzle on one end of the barrel member and a piston element which is sealingly received in the barrel member and slidable therein in a direction toward the nozzle for dispensing a viscous fluid from the barrel member. The barrel member and the piston element are constructed so that the piston element is freely slidable in a reverse direction in the barrel member to relieve the pressure on the fluid in the barrel member after a dispensing operation has been completed and to thereby eliminate post extrusion from the dispenser. The dispenser is operative in combination with a dispenser gun which includes a drive plunger and an advancing mechanism which is operative for advancing the drive plunger in order to advance the piston element of the dispenser in the barrel member thereof. The advancing mechanism is further operative for automatically retracting the drive plunger after a dispensing operation has been completed so that the piston element is free to move rearwardly in the barrel member to relieve the pressure on the fluid in the barrel member.

27 Claims, 2 Drawing Sheets

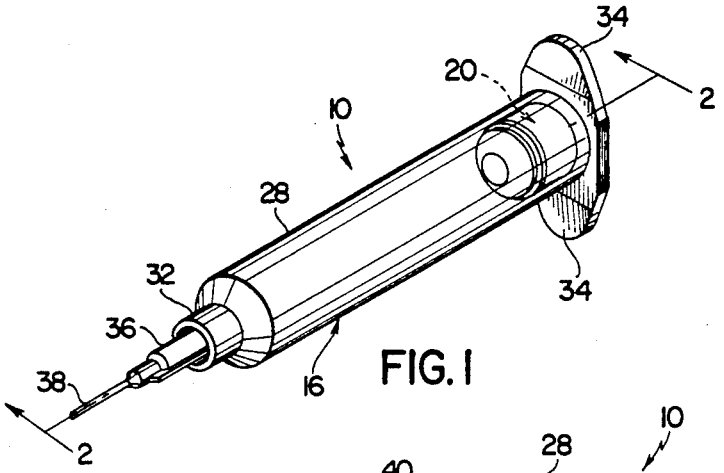
FIG. 1
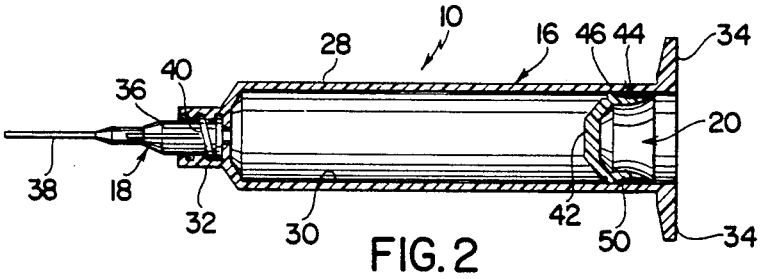
FIG. 2
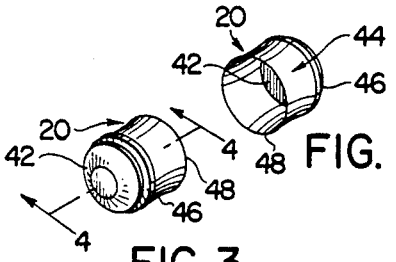
FIG. 3a
FIG. 3
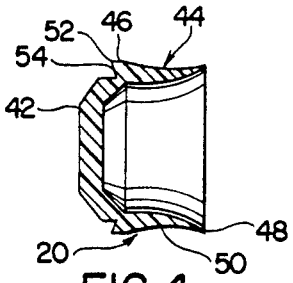
FIG. 4
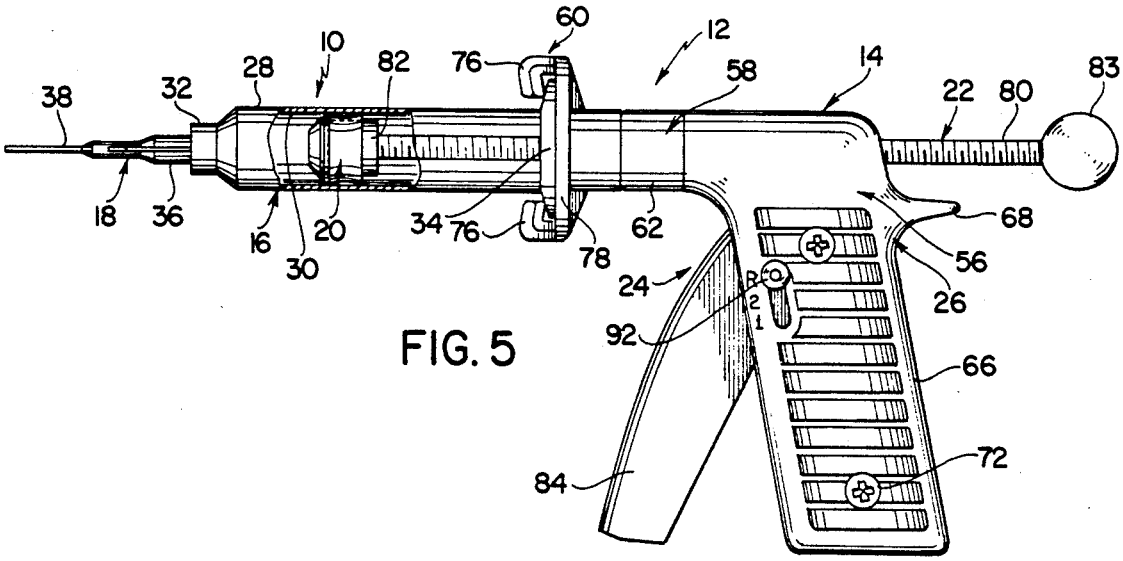
FIG. 5

DISPENSER-GUN ASSEMBLY FOR VISCOUS FLUIDS AND DISPENSER THEREFOR

BACKGROUND AND SUMMARY OF THE INVENTION

The instant invention relates to dispensers for viscous fluids and more particularly to a dispenser-gun assembly which is operative for effectively and accurately dispensing controlled amounts of a viscous fluid and to a dispenser for the dispenser-gun assembly.

The general concept of selectively dispensing a viscous fluid from a pressurizable chamber through a reduced dispensing nozzle has been known for many years and has been effectively embodied in a wide variety of dispensing apparatus for dispensing various types of viscous fluids and pastes. In this regard, various dispenser-gun assemblies have heretofore been widely used for dispensing various viscous fluids and pastes, including various lubricants, sealants, and caulking materials. Dispenser-gun assemblies of this type have generally comprised dispenser units including elongated tubular members, piston elements which are snugly yet slidably received in the tubular members thereof and nozzles which communicate with the interiors of the tubular members thereof for dispensing fluids therefrom as the piston elements thereof are advanced in the tubular members. Dispenser-gun assemblies of this type have generally further comprised double pawl type ratcheting dispenser guns which are operative for advancing the pistons of dispensers in the respective tubular members thereof for dispensing fluids from the tubular chamber. The dispenser guns of dispenser-gun assemblies of this type have generally included squeezable handle and trigger assemblies which are operative for advancing the pistons of dispensers in the respective tubular members thereof and for maintaining the pistons in advanced positions when the trigger portions of the dispenser guns are released. As a result, the heretofore available dispenser-gun assemblies have generally been operative by squeezing the trigger portions of the dispenser guns thereof for advancing the pistons of the dispensers received therein in stepped increments. However, they have generally not been operative for automatically releasing the pressures applied to fluids contained in the dispensers thereof after dispensing operations have been completed.

Various more sophisticated dispensers and dispenser-gun assemblies have also been heretofore available for more precisely dispensing controlled amounts of viscous fluids, such as various epoxies, solder pastes and solder creams. The heretofore available dispensers for dispensing fluids of these types have generally been more similar in construction to conventional medical syringes and they have comprised barrel portions having tubular cylindrical chambers therein, nozzle portions including reduced dispensing tips or needles and piston elements which are slidably received in sealing engagement in the barrel portions thereof so that they are advanceable toward the respective nozzle portions thereof for dispensing fluids from the chambers thereof. Dispensers of this type have generally comprised elastomeric piston elements which are received in the barrel portions thereof with relatively high levels of interference fit to seal between the barrel portions and piston elements thereof. Dispensers of this type have generally been utilized in combination with gun assemblies which are similar in concept and operation to the double pawl ratchet type gun assemblies hereinabove described but which are adapted to effect somewhat more precise movement of the pistons of syringe type dispensers in the chamber thereof. Alternatively, dispensers of this type have been utilized in combination with pneumatic dispensing apparatus which have been operative for applying controlled amounts of air pressure to the pistons of dispensers in order to advance the pistons thereof in their respective chambers.

One of the main disadvantages of the heretofore available dispensing apparatus of the above described types is that they have generally been operative with significant amounts of post extrusion which occurs after the desired amounts of fluids have been dispensed from the cylinders or barrel portions thereof. Post extrusion is generally caused by the expansion of the pressurized fluids remaining in dispensers after the desired amounts of fluids have been dispensed therefrom. In this regard, while most pure viscous fluids are essentially non compressible, it has been found that many viscous fluids contain substantial quantities of entrapped air which cause them to exhibit significant levels of compressibility. It has been further found that because the heretofore available dispensers have generally had relatively high levels of frictional resistance between the pistons and the barrel portions thereof, the pistons of the heretofore available dispensers have not been sufficiently freely movable to relieve the pressures on fluids contained therein, even after all of the externally applied forces have been removed from the pistons thereof. Consequently, virtually all of the heretofore available dispensers of this general type have been found to operate with excessive amounts of post extrusion and it has not been possible to dispense accurate quantities of viscous fluids from the previously known piston-cylinder type fluid dispensers.

The instant invention provides an effective dispenser-gun assembly and dispenser which are operative for dispensing viscous fluids without significant amounts of post extrusion. In this regard, the dispenser of the instant invention is adapted to minimize the frictional resistance between the piston and cylinder thereof so that the piston is freely moveable in a reverse direction in the cylinder thereof to relieve pressure on a fluid contained in the cylinder while nevertheless maintaining an effective seal between the piston and the cylinder wall. The dispenser gun which is operative in combination with the dispenser includes a drive plunger which is operative for advancing the piston in the cylinder. However, while the dispenser gun is adapted so that it is manually actuatable for advancing the drive plunger to advance the piston in the cylinder, it is further adapted so that the drive plunger is automatically retracted to release the pressure applied to the piston by the plunger unless the dispenser gun is operated to manually maintain the piston in an advanced position. Accordingly, unless the actuating mechanism of the dispenser gun is manually held in an actuated position at the end of a dispensing operation, the drive plunger is automatically retracted so that it is disengaged or partially disengaged from the piston. Further, because the dispenser is constructed to minimize the frictional resistance between the piston and the cylinder, the piston is freely movable in a rearward or reverse direction in the cylinder to relieve the expansive forces in a fluid contained in the cylinder.

The dispenser of the instant invention which is adapted to minimize post extrusion comprises an elongated tubular barrel member having an elongated cylindrical chamber therein, the chamber having a zero draft throughout its effective length, a nozzle element on one end of the barrel member and a piston element which is slidably received in the chamber so that it is operative for applying pressure to a fluid contained in the chamber. The piston element and the barrel member are preferably constructed so that the frictional resistance between the piston element and the barrel member is between approximately 0.5 and 2.5 pounds per square inch of barrel cross sectional area. The piston element is preferably received in the chamber with an interference fit of between 0.02 inches and 0.07 inches and it is preferably made of a thermoplastic material having a flexual modulus of between 180,000 pounds per square inch and 210,000 pounds per square inch. Further, because the barrel member has a zero draft throughout its length, the interference fit between the piston element and the barrel member is substantially uniform throughout the length of the barrel member. The piston element preferably includes a circular front end wall portion and a tubular skirt portion which extends rearwardly from the front end wall portion. The skirt portion preferably includes an annular front wiping lip adjacent the front end wall portion, an annular rear wiping lip which is spaced rearwardly from the front wiping lip and a recessed intermediate portion of preferably concave configuration which extends between the front and rear wiping lips. The front wiping lip preferably tapers forwardly and outwardly to a forward wiping edge, and it is preferably partially defined by an undercut annular notch which extends rearwardly and inwardly from the forward wiping edge. The front wiping lip is preferably received in the chamber with an interference fit of between 0.002 inches and 0.007 inches and the front and rear wiping lips are preferably spaced by an amount equal to approximately one half of the diameter of the chamber. The piston element is preferably made of low density polyethylene and the barrel member is preferably made of a thermoplastic material other than polyethylene.

The dispenser gun of the instant invention comprises a drive plunger which is receivable in engagement with the piston element of a dispenser of the above type and mechanical advancing means for mechanically advancing the drive plunger in order to mechanically advance the piston element in the chamber thereof. The mechanical advancing means is adapted so that it is operative for mechanically advancing the drive plunger from a first position in the chamber to a second or inwardly advanced position therein and for immediately, automatically, mechanically returning the drive plunger to the first position in the chamber unless the advancing means manually maintained in a position wherein the drive plunger is in an advanced or partially advanced position in the chamber. The dispenser gun preferably includes a handle section and the advancing means preferably includes a trigger section which is manually resiliently squeezable or compressible toward the handle section for advancing the drive plunger element from a first position in the chamber to a second further advanced position therein. Further, the advancing means is constructed so that the drive plunger element is automatically and immediately returned to the first position thereof and so that the trigger section is automatically resiliently returned to the initial or unsqueezed position thereof unless the trigger section is manually held in an actuated, squeezed or partially squeezed position. The drive plunger preferably includes a plunger rod having a plurality of sequential notches therein and the advancing means preferably includes a pawl member attached to the trigger section which is engageable with the rod in one of the notches for advancing the drive plunger element from the first position thereof to the second position thereof in the chamber as the trigger section is squeezed toward the handle section and for returning the drive plunger element to the first position thereof when the trigger section is released.

It has been found that the dispenser and the dispenser-gun assembly of the instant invention can be effectively utilized for accurately and precisely dispensing a viscous fluid without significant amounts of post extrusion. In this regard, because of the construction of the piston element and of the resiliency and low friction characteristics of the material from which it is preferably constructed and because of the zero draft construction of the barrel member and the low friction characteristics of the material from which the barrel member is preferably constructed, the piston element is capable of effecting an essentially leak proof seal between the piston element and the barrel member while nevertheless being relatively freely slidable in the barrel member. Further, because the dispenser gun is constructed so that the plunger element is automatically retracted unless it is manually maintained in an advanced or partially advanced position in the chamber, the plunger element is automatically retracted from the piston element at the end of a dispensing operation. Consequently, the piston element can freely move rearwardly in the barrel member at the end of a dispensing operation to relieve the pressure on the fluid remaining in the barrel member and to thereby eliminate any significant post extrusion from the dispenser.

Accordingly, it is a primary object of the instant invention to provide an effective dispenser which is operative for dispensing a viscous fluid without significant amounts of post extrusion.

Another object of the instant invention is to provide a dispenser comprising a piston element and a barrel member wherein the piston element is slidable in a reverse direction in the barrel member with minimal frictional resistance.

Another object of the instant invention is to provide a dispenser-gun assembly which is operative for dispensing a viscous fluid without significant amounts of post extrusion.

An even still further object of the instant invention is to provide a dispenser-gun assembly comprising a dispenser gun including a plunger element which is manually advanceable for dispensing a fluid from a dispenser but which is automatically retracted unless manually maintained in an advanced position.

Other objects, features and advantages of the invention shall become apparent as the description thereof proceeds when considered in connection with the accompanying illustrative drawings.

DESCRIPTION OF THE DRAWINGS

In the drawings which illustrates the best mode presently contemplated for carrying out the present invention:

FIG. 1 is a perspective view of the dispenser of the instant invention;

FIG. 2 is a sectional view taken along line 2—2 in FIG. 1;

FIG. 3 is a front perspective view of the piston element thereof;

FIG. 3*a* is a rear perspective view of the piston element;

FIG. 4 is a sectional view taken along line 4—4 in FIG. 3;

FIG. 5 is a side elevational view of the dispenser-gun assembly shown partially in section;

DESCRIPTION OF THE INVENTION

Figure 6:
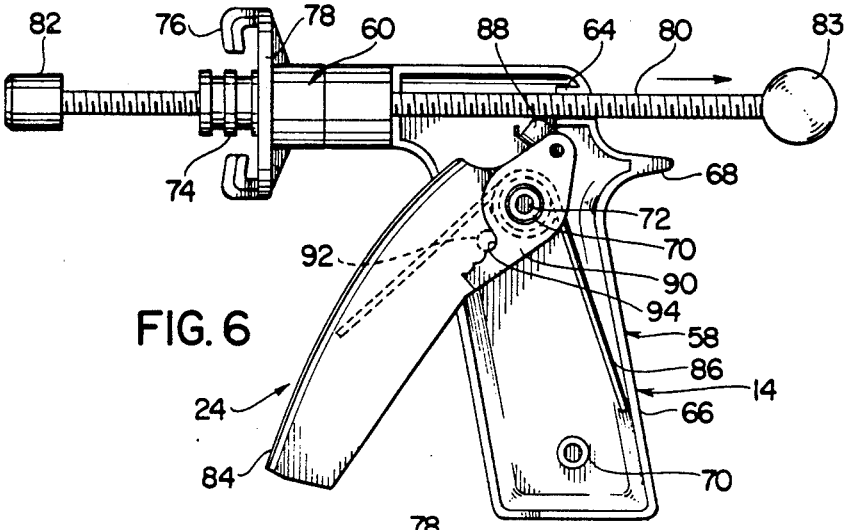
FIG. 6 is a side elevational view of the dispenser gun in a released position with one of the body portion sections removed.
Figure 7:
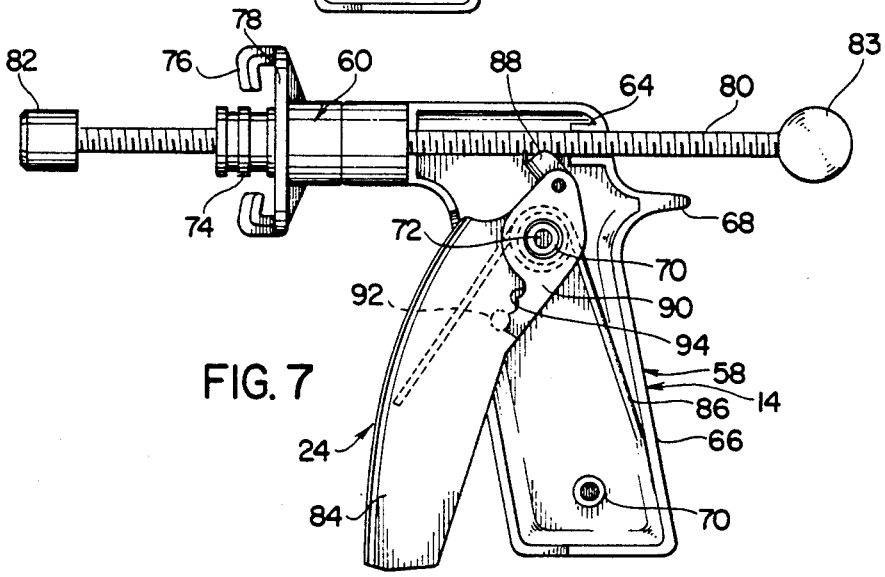
FIG. 7 is a similar view with the drive plunger in a retracted position.

Referring now to the drawings, the dispenser of the instant invention is illustrated and generally indicated at 10 in FIGS. 1, 2 and 5 and the dispenser-gun assembly of the instant invention is illustrated and generally indicated at 12 in FIG. 5. The dispenser-gun assembly 12 includes the dispenser 10 and a gun generally indicated at 14 which is further illustrated in FIGS. 5 through 8. The dispenser 10, which is adapted for use in combination with either the gun 14 or a conventional pneumatic dispenser apparatus, includes a barrel member generally indicated at 16, a nozzle element generally indicated at 18 and a piston element generally indicated at 20 which is slidably received in the interior of the barrel member 16. The piston element 20 is advanceable in the barrel member 16 in a direction toward the nozzle element 18 for dispensing a viscous fluid from the barrel member 16 through the nozzle element 18. The gun 14 comprises a drive plunger assembly generally indicated at 22, an advancing mechanism generally indicated at 24 and a body portion generally indicated at 26. The drive plunger assembly 22 and the advancing mechanism 24 are mounted in the body portion 26 so that the advancing mechanism 24 is operative for longitudinally advancing and retracting the drive plunger assembly 22. The dispenser 10 is receivable in assembled relation with the gun 14 in the manner illustrated in FIG. 5 so that the drive plunger assembly 22 is advanceable in the dispenser 10 for advancing the piston element 20 in a direction toward the nozzle element 18 in order to dispense a viscous fluid from the barrel member 16.

Referring more specifically to the dispenser 10, the barrel member 16 is preferably integrally molded from a substantially rigid low friction thermoplastic material, such as polypropylene and it includes an elongated tubular main portion 28 having a tubular cylindrical chamber 30 formed therein. A reduced tubular nozzle connector portion 32 having female threads therein is integrally formed at a first end of the main portion 28 and a connector flange portion 34 is integrally formed at the opposite or second end of the main portion 28. The main portion 28 is formed so that it has a zero draft or taper throughout the effective length of the chamber 30 and so that the interior surface of the main portion 28 is substantially smooth and continuous throughout its length. Accordingly, the frictional resistance to the movement of the piston element 20 in the main portion 28 is essentially constant throughout the length of the main portion 28. In addition, the barrel portion 16 is preferably molded from a thermoplastic material which is different from the material from which the piston element 20 is constructed in order to further minimize the coefficient of friction between the piston element 20 and the barrel member 16.

The nozzle element 18 includes a base portion 36 which is preferably integrally molded from a thermoplastic, such as polypropylene and a tubular dispensing needle portion 38 which extends into the interior of the base portion 36. The base portion 36 has male threads 40 formed thereon and it is received in threaded engagement in the nozzle connector portion 32 so that the tubular dispensing needle 38 is in communication with the chamber 30 for dispensing a viscous fluid from the chamber 30 through the orifice defined by the tubular interior of the dispensing needle portion 38.

The piston element 20 is preferably integrally molded from a thermoplastic material and it is dimensioned to be received in the interior of the chamber 30 with an interference fit of between 0.002 inches and 0.007 inches. The piston element 20 is preferably integrally molded from a thermoplastic material which is different from the material from which the barrel portion 16 is constructed. Specifically, the piston element 20 is preferably integrally molded from low density linear polyethylene so that it has a sufficient degree of resiliency and flexibility to effect a seal between the piston element 20 and the inner surface of the main portion 28 without requiring a high degree of interference fit between the piston element 20 and the main portion 16 such as would inherently create significant frictional resistance therebetween. In this regard, the piston element 20 is preferably constructed from a thermoplastic material having a flexual modulus of between 180,000 pounds per square inch and 210,000 pounds per square inch in order to effect the desired seal between the piston element 20 and the wall of the chamber 30. The piston element 20 comprises a substantially circular front end wall portion 42, and a skirt portion 44 which extends rearwardly from the front end wall portion 42 to add longitudinal stability to the piston element. The skirt portion 44 preferably extends rearwardly from the front end wall portion by an amount equal to at least half the diameter of the front end wall portion and it includes an annular front wiping lip 46 adjacent the front end wall portion 42, an annular rear wiping lip 48 and a recessed intermediate portion 50 of preferably concave configuration which extends between the front wiping lip 46 and the rear wiping lip 48. The front wiping lip 46 preferably tapers forwardly and outwardly to a forward wiping edge 52 and it is preferably partially defined by an undercut notch 54 which extends rearwardly and inwardly from the forward wiping edge 52. In this regard, it has been found that by constructing the front wiping lip 46 in this manner the resiliency of the material from which the piston element 20 is preferably constructed allows the front wiping lip 46 to be compressed slightly as a result of the interference fit between the front wiping lip 46 and the inner wall of the chamber 30. Further, because of the configuration of the front wiping lip 46, the interference fit between the front wiping lip 46 and the inner wall of the chamber 30 and the materials from which the piston element 20 and the barrel member 16 are preferably constructed, it is possible to achieve an effective seal between the piston element 20 and the barrel member 16 while nevertheless minimizing the frictional resistance between the piston element 20 and the barrel member 16. In this regard, it has been found that by constructing the piston element 20 and the barrel member 16 in accordance with the parameters hereinabove set forth it is possible to maintain the frictional resistance between the piston element 20 and the barrel member 16 within a range of between approximately 0.5 and 2.5 pounds per square inch of cross sectional area of the chamber 30 while nevertheless achieving an effective seal between the piston element 20 and the barrel member 16.

It has been found that because of the construction of the barrel member 16 and the piston element 20 the piston element 20 is sufficiently freely slidable in the barrel member 16 to effectively relieve any pressures built up in a fluid contained in the barrel member 16 during a dispensing operation. More specifically, the pressures built up on a fluid contained in the chamber 30 by advancing the piston element 20 in a direction toward the nozzle element 18 can be relieved simply by discontinuing the application of external pressure to the piston element 20 to allow the piston element 20 to be moved in a rearward or reverse direction in the chamber 30 by the expansive forces in the fluid in the chamber 30. In this regard, it has been found that by constructing the piston element 20 and the barrel member 16 in the manner hereinabove set forth, virtually all of the expansion which takes place in a fluid contained in the chamber 30 when externally applied pressure is released from the piston element 20 is relieved by moving the piston element 20 rearwardly in the chamber 30 rather than by forcing fluid outwardly through the dispensing needle 38.

Referring now to FIGS. 5 through 8 and as hereinabove set forth, the gun 14 comprises the drive plunger assembly 22, the advancing mechanism 24 and the body portion 26. The drive plunger assembly 22 and the advancing mechanism 24 are mounted in the body portion 26 so that the advancing mechanism 24 is operative for longitudinally advancing and retracting the drive plunger assembly 22. The body portion 26 is adapted for receiving the dispenser 10 in assembled relation therewith so that the dispenser 10 is axially aligned with the drive plunger assembly 22 as illustrated in FIG. 5. Accordingly, by manipulating the advancing mechanism 24 the drive plunger assembly 22 can be utilized for advancing the piston 20 in the barrel member 16 in order to dispense a viscous fluid from the chamber 30 through the dispensing needle 38. In this regard, however, the advancing mechanism 24 is adapted so that once advanced, it automatically returns to a retracted position unless it is manually held in an advanced or partially advanced position. Accordingly, unless the advancing mechanism 24 is manually held in an advanced or partially advanced position, the drive plunger assembly 22 is automatically disengaged or partially disengaged from the piston element 20 to enable the piston element 20 to be moved rearwardly in the chamber 30 in order to relieve pressure from a fluid contained in the chamber 30.

The body portion 26 comprises first and second body portion sections generally indicated at 56 and 58, respectively, which are preferably made from a suitable metal and cooperate to define a "pistol grip" type housing, and a dispenser clamp portion generally indicated at 60. The second body portion section 58 includes a cylindrical front portion 62 having a reduced aperture (not shown) therethrough for receiving and guiding the drive plunger assembly 22 in its longitudinal movement. A semicircular rear interior boss 64 is formed in each of the body portion sections 56 and 58 so that when the body portion sections 56 and 58 are assembled together the bosses 64 cooperate to define a reduced aperture for further guiding the drive plunger assembly 22 in its longitudinal movement. The body portion sections 56 and 58 also include handle portion sections 66 and rear thumb support sections 68 which project rearwardly from the handle portion sections 66. A spaced pair of threaded bosses 70 project inwardly into the interior of the handle portion section 66 of the second body portion section 58 and corresponding bosses (not shown) of reduced length project inwardly into the interior of the handle portion section 66 of the first body portion section 56. The inwardly projecting tubular bosses in the handle portion sections 66 are received in substantially aligned mating engagement in the interior of the body portion 26 and screws 72 which are received in threaded engagement in the bosses 70 maintain the first and second body portion sections 56 and 58, respectively, in assembled relation. The dispenser clamp portion 60 is permanently attached to the cylindrical front portion 62 of the second body portion section 58 and it is preferably integrally molded from a suitable plastic material. The clamp portion 60 is of conventional construction and it includes a central portion 74, a pair of resilient jaw portions 76 and a flange portion 78. The clamp portion 60 is adapted for receiving and securing the dispenser 10 to the gun 14 so that the dispenser 10 is substantially longitudinally aligned with the drive plunger assembly 22. More specifically, the clamp portion 60 is adapted for receiving the dispenser 10 so that the central portion 74 is received in engagement in the open end portion of the barrel member 16 and so that the flanges 34 are received in clamping engagement in the jaw portions 76 for urging the flanges 34 and the adjacent end portions of the barrel member 16 into engagement with the flange portion 78. In this regard, the clamp portion 60 is adapted for receiving the dispenser 10 in engagement therewith by inserting the central portion 74 into the barrel member 16 and then rotating the dispenser 10 to move the flanges 34 into clamping engagement in the jaw portions 76.

The drive plunger assembly 22 comprises an elongated cylindrical threaded drive plunger rod 80, a drive plunger element 82 on one end of the rod 80 and a ball element 83 on the opposite end of the rod 80. The rod 80 as herein embodied comprises a cylindrical threaded rod, although the use of various other types of rods which have notches or grooves along the lengths thereof in place of the rod 80 is contemplated. The drive plunger element 82 is of generally cylindrical configuration and it is dimensioned to be received in the interior of the piston element 20.

Figure 8:
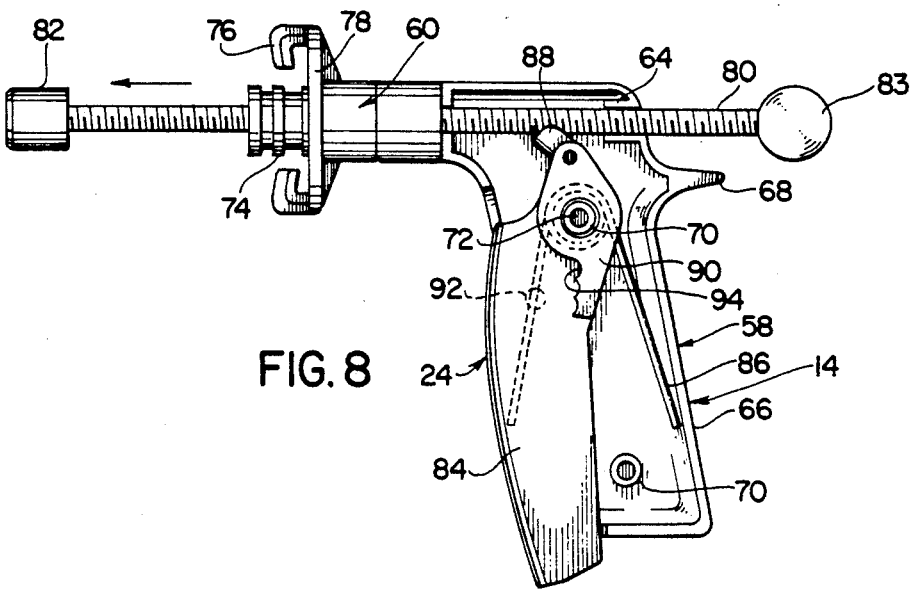
FIG. 8 is a similar view with the drive plunger in an advanced position.

The advancing assembly 24 comprises a trigger portion 84 which is pivotally mounted on one of the bosses 70, a torsion spring 86 which is received on the same boss 70 so that it engages both the trigger portion 84 and the second body portion section 58 for biasing the trigger portion 84 to a forwardly pivoted position, a pawl member 88, an adjustment plate 90 and an adjustment pin 92. The pawl member 88 is pivotally attached to the trigger portion 84 and a torsion spring (not shown) is coaxially mounted with the pawl member 88 on the trigger portion 84 so that it biases the pawl member 88 to an upwardly pivoted position wherein it engages the drive plunger rod 80. Accordingly, by squeezing or drawing the trigger portion 84 rearwardly toward the handle portion sections 66, the pawl member 88 is operative for advancing the drive plunger assembly 22 forwardly as illustrated in FIG. 8. However, because the pawl member 88 is biased to a position of engagement with the rod 80, the pawl member 88 normally remains in engagement with the rod 80 when the trigger portion 84 is released so that the rod 80 is returned to its original position as the trigger portion 84 is pivoted forwardly by the spring 86. In other words, when the trigger portion 84 is squeezed or drawn rearwardly toward the first handle portion sections 66, the drive plunger assembly 22 is advanced longitudinally forwardly from a first position to a second further advanced position and when the trigger portion 84 is released, the trigger portion 84 is returned to its original position by the spring 86 and the drive plunger assembly 22 is returned to its original or first position by the pawl member 88.

The adjustment plate 90 is integrally formed with the trigger portion 84 and it has a series of adjustment notches 94 formed therein. As illustrated in FIG. 5, the adjustment pin 92 is slidably received in a slot in the handle portion section 66 of the first body portion section 56 so that it is adjustably positionable in the different notches 94. As illustrated in FIG. 6, when the adjustment pin 92 is received in the uppermost notch 94, the trigger portion 84 is normally maintained in a fully forwardly pivoted position wherein the pawl member 88 engages the boss 64 to disengage the pawl member 88 from the rod 80. However, when the second trigger portion 84 is drawn rearwardly toward the handle portion sections 66, the pawl member 88 is again pivoted into engagement with the rod 80. As a result, when the adjustment pin 92 is in its uppermost position and the trigger portion 84 is in its normal fully forwardly pivoted position, the drive plunger assembly 22 can be longitudinally repositioned in the body portion 26. By repositioning the adjustment pin 92 so that it is received in one of the other notches 94, the trigger portion 84 is pivoted inwardly or rearwardly slightly when it is in its normal or at rest position so that the pawl member 88 is disengaged from the boss 64 and maintained in engagement with the rod 80. Accordingly, the drive plunger assembly 22 cannot normally be longitudinally advanced in a rearward direction because of the forwardly angled pawl member 88. However, because the pawl member 88 is angled forwardly and upwardly toward the rod 80, the drive plunger assembly 22 can be manually longitudinally repositioned in a forward direction with respect to the body portion 26 by urging the ball element 83 forwardly.

Accordingly, for use and operation of the dispenser-gun assembly 12, the adjustment pin 92 is first moved to the uppermost notch 94 and the drive plunger assembly 22 is moved rearwardly to a fully retracted position. The dispenser 10 is then assembled with the clamp assembly 60 so that the central portion 74 is received in the interior of the barrel member 16 and so that the flanges 34 are received in engagement in the jaw portions 76. The adjustment pin 92 is then repositioned in one of the other notches 94 and the drive plunger assembly 22 is manually advanced forwardly until it is received in engagement in the interior of the piston element 20. By thereafter drawing the trigger portion 84 rearwardly toward the handle portion sections 66, the drive plunger element 82 is advanced forwardly by the pawl member 88 to advance the piston element 20 in the chamber 30 so that a fluid contained in the chamber 30 is dispensed through the dispensing needle 38. Once a desired quantity of fluid has been dispensed from the chamber 30 in this manner the trigger portion 84 is released so that it is resiliently returned to its original forwardly pivoted position. As the trigger portion 84 is returned to its original forwardly pivoted position the drive plunger assembly 22 is moved rearwardly to its original retracted position by the pawl member 88 and hence the drive plunger element 82 is normally either fully or partially disengaged from the piston element 20 so that the external pressure applied to the piston element 20 by the drive plunger element 82 is released. Since the piston element 20 is freely slidable in a rearward direction in the barrel member 16, the piston element 20 is normally moved rearwardly in the barrel member 16 by the expansion of the fluid in the chamber 30 to relieve the internal pressure on the fluid. As a result, post extrusion of fluid from the chamber 30 through the dispensing needle 38 is effectively eliminated so that the amount of fluid dispensed from the chamber 30 can be precisely controlled by appropriately manipulating the dispenser gun 14.

It is seen therefore that the instant invention provides an effective dispenser and dispenser-gun assembly for dispensing viscous fluids. The dispenser 10 and the dispenser gun 14 are specifically adapted to enable pressure on a fluid contained in the chamber 30 to be automatically released at the end of a dispensing operation. Accordingly, the dispenser-gun assembly 12 can be affectively operated for precisely dispensing controlled quantities of a viscous fluid without significant post extrusion. Hence, it is seen that the dispenser 10 and the dispenser-gun assembly 12 represent significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A dispenser for a viscous fluid comprising:

a) an elongated molded tubular barrel member having an elongated cylindrical chamber therein for containing said fluid, said chamber having opposite first and second ends and having a predetermined length, said chamber having a zero draft throughout said predetermined length;

b) nozzle means defining a dispensing nozzle having a reduced dispensing aperture therein, said nozzle means communicating with the first end of said chamber for receiving said fluid therefrom and for dispensing said fluid through said aperture when pressure is applied to said fluid; and c) a piston element slidably received in said chamber, said piston element being made of a thermoplastic material such that the frictional resistance between the piston element and the barrel member is substantially reduced, said piston element being operative for applying pressure to said fluid for dispensing said fluid through said aperture when pressure is applied to said piston element in a direction toward said first end, said piston element having a circular front end wall portion, and a tubular skirt portion extending rearwardly from said front end wall portion, said skirt portion including an annular front wiping lip adjacent said front end wall portion, said front wiping lip being received in said chamber with an interference fit of between 0.002 inches and 0.007 inches, said skirt portion further including an annular rear wiping lip spaced rearwardly from said front wiping lip.

2. In the dispenser of claim 1, said piston element being made of low density polyethylene.

3. In the dispenser of claim 1, said skirt portion further including a recessed intermediate portion extending between said front and rear wiping lips.

4. In the dispenser of claim 3, said piston element being made of low density polyethylene.

5. In the dispenser of claim 2, said barrel member being made of a thermoplastic other than polyethylene.

6. In the dispenser of claim 3, said front and rear wiping lips being spaced by an amount equal to approximately one half the diameter of said chamber.

7. In the dispenser of claim 1, the frictional resistance between said piston element and said barrel member being between approximately 0.5 and 2.5 pounds per square inch of chamber cross sectional area.

8. In the dispenser of claim 3, the outwardly facing side of said recessed intermediate portion being concave.

9. In the dispenser of claim 1, the flexual modulus of said thermoplastic material being between 180,000 pounds per square inch and 210,000 pounds per square inch.

10. In the dispenser of claim 7, the flexual modulus of said thermoplastic material being between 180,000 pounds per square inch and 210,000 pounds per square inch.

11. In the dispenser of claim 1, said front wiping lip tapering forwardly and outwardly to a forward wiping edge and being partially defined by an undercut annular notch which extends rearwardly and inwardly from said forward wiping edge.

12. A dispenser-gun assembly for dispensing a viscous fluid comprising a) a dispenser portion comprising;

i) an elongated tubular barrel member having an elongated cylindrical chamber therein for containing said fluid, said chamber having opposite first and second ends and having a predetermined length;

ii) nozzle means defining a dispensing nozzle having a reduced dispensing aperture therein, said nozzle means communicating with the first end of said chamber for receiving said fluid therefrom and for dispensing said fluid through said aperture when pressure is applied to said fluid; and iii) a piston element slidably received in said chamber, said piston element being received in said chamber with an interference fit and being operative for applying pressure to said fluid for dispensing said fluid through said aperture when pressure is applied to said piston element in a direction toward said first end; and b) a gun portion comprising;

i) a drive plunger including a drive plunger element receivable in engagement with said piston element for advancing said piston element toward said first end and for thereby applying pressure to said fluid and a drive plunger rod for advancing said drive plunger element in said chamber; and ii) mechanical advancing means for mechanically advancing said drive plunger in said cylinder toward said first end, said mechanical advancing means being manually operable for mechanically advancing said drive plunger element toward said first end from a first position in said chamber to a second position therein and for normally automatically immediately mechanically returning said drive plunger to said first position unless said drive plunger is manually maintained in an advanced or partially advanced position in said chamber.

13. The dispenser-gun assembly of claim 12 further comprising a body portion including a handle section, said advancing means being mounted on said body portion and comprising a trigger portion, said trigger portion being manually resiliently movable toward said handle section for advancing said drive plunger element from said first position in said chamber to said second position therein, said drive plunger element automatically and immediately returning to said first position and said trigger portion being resiliently separated from said handle section when said trigger portion is released.

14. In the dispenser-gun assembly of claim 12, said drive plunger being manually repositionable in said cylinder independently of said mechanical advancing means.

15. In the dispenser-gun assembly of claim 13, said plunger rod having a plurality of sequential notches therein, said advancing means further including a pawl attached to, said pawl engaging said rod in one of said notches for advancing said drive plunger element in said chamber as said trigger portion is manually drawn toward said handle section, said pawl returning said drive plunger element to said first position when said trigger portion is released.

16. In the dispenser-gun assembly of claim 12, said barrel member having a zero draft throughout said predetermined length, said piston element being made of a thermoplastic material and being received in said chamber with an interference fit of between 0.002 inches and 0.007 inches.

17. In the dispenser-gun assembly of claim 16, said piston element being made of low density polyethylene.

18. In the dispenser-gun assembly of claim 17, said piston element having a circular front end wall portion and a tubular skirt portion extending rearwardly from said front end wall portion, said skirt portion including an annular front wiping lip adjacent said front end wall, an annular rear wiping lip spaced rearwardly from said front wiping lip and a recessed intermediate portion extending between said front and rear wiping lips, said front wiping lip being received in an interference fit of between 0.002 inches and 0.007 inches.

19. In the dispenser-gun assembly of claim 18, said piston element being made of low density polyethylene.

20. In the dispenser-gun assembly of claim 17, said barrel member being made of a thermoplastic other than polyethylene.

21. In the dispenser-gun assembly of claim 18, said front and rear wiping lips being spaced by an amount equal to approximately one half the diameter of said chamber.

22. In the dispenser-gun assembly of claim 16, the frictional resistance between said piston element and said barrel member being between approximately 0.5 and 2.5 pounds per square inch of chamber cross sectional area.

23. In the dispenser-gun assembly of claim 18, the outwardly facing surface of said recessed intermediate portion being concave.

24. A gun for dispensing a viscous fluid from a fluid dispenser of a type including an elongated tubular barrel member having an elongated cylindrical chamber therein for containing said fluid, a nozzle element on one end of said barrel member, said nozzle element defining a reduced dispensing aperture and communicating with said chamber for dispensing fluid therefrom through said aperture and a piston element slidably and sealingly received in said chamber, said piston element being advanceable toward said nozzle element for applying pressure to said fluid, said gun comprising:

a) a drive plunger including a drive plunger element receivable in engagement with said piston element for advancing said piston element toward said first end and for thereby applying pressure to said fluid and a drive plunger rod for advancing said drive plunger element in said chamber; and b) mechanical advancing means for mechanically advancing said drive plunger in said cylinder toward said first end, said mechanical advancing means being manually operable for advancing said drive plunger element toward said first end from a first position in said chamber to a second position therein, said drive plunger element normally automatically immediately mechanically returning to said first position unless said drive plunger element is manually maintained in an advanced position in said chamber with said advancing means.

25. The gun of claim 24 further comprising a body portion including a handle section, said advancing means comprising a trigger portion, said trigger portion being manually resiliently movable toward said handle section for advancing said drive plunger element from said first position in said chamber to said second position therein, said drive plunger element automatically and immediately returning to said first position and said trigger portion being resiliently separated from said handle section when said trigger portion is released.

26. In the dispenser gun of claim 24, said drive plunger being manually repositionable in said cylinder independently of said mechanical advancing means.

27. In the dispenser gun of claim 25, said plunger rod having a plurality of sequential notches therein, said handle advancing means further including a pawl attached to said trigger portion, said pawl engaging said rod in one of said notches for advancing said drive plunger element in said chamber as said trigger portion is manually drawn toward said handle section, said pawl returning said drive plunger element to said first position when said trigger portion is released.

* * * * *